United States Patent [19]

Tavernier et al.

[11] Patent Number: 4,879,198

[45] Date of Patent: Nov. 7, 1989

[54] MAGNETIC CARRIER PARTICLES

[75] Inventors: Serge M. Tavernier, Lint; Joannes J. Van Beek, Ravels; Pierre L. van Daele, Wilrijk, all of Belgium

[73] Assignee: AGFA-Gevaert N.V., Mortsel, Belgium

[21] Appl. No.: 178,929

[22] Filed: Apr. 7, 1988

[30] Foreign Application Priority Data

Apr. 24, 1987 [EP] European Pat. Off. ..... 87200778

[51] Int. Cl.[4] ..... G03G 9/14

[52] U.S. Cl. ..... 430/106.6; 430/108; 430/111

[58] Field of Search ..... 430/106.6, 108, 111, 430/904

[56] References Cited

U.S. PATENT DOCUMENTS

| | | | |
|---|---|---|---|
| 4,451,837 | 5/1984 | Gruber et al. | 430/106.6 X |
| 4,487,825 | 12/1984 | Gruber et al. | 430/106.6 |
| 4,504,562 | 3/1985 | Miyakawa et al. | 430/106.6 |
| 4,533,614 | 8/1985 | Fukumoto et al. | 430/904 X |
| 4,657,837 | 4/1987 | Morita et al. | 430/904 X |
| 4,675,268 | 6/1987 | Kishi et al. | 430/106.6 X |

FOREIGN PATENT DOCUMENTS

| | | | |
|---|---|---|---|
| 60-214368 | 10/1985 | Japan | 430/107 |
| 60-214369 | 10/1985 | Japan | 430/107 |
| 62-35369 | 2/1987 | Japan | 430/106.6 |
| 62-195678 | 8/1987 | Japan | 430/904 |
| 62-195679 | 8/1987 | Japan | 430/904 |
| 62-195680 | 8/1987 | Japan | 430/904 |
| 62-195681 | 8/1987 | Japan | 430/904 |

*Primary Examiner*—Paul R. Michl
*Assistant Examiner*—Jeffrey A. Lindeman
*Attorney, Agent, or Firm*—William J. Daniel

[57] ABSTRACT

A particulate material suited for serving as carrier particles for finely-divided toner particles in magnetic brush toner-carrier development of electrostatic charge patterns, said carrier particles comprising finely divided magnetite powder dispersed in a resin binder, characterized in that said magnetite powder is a mixture of magnetites wherein one type (A) of the magnetite has an oil absorption number in the range of 10 to 20 g/100 g pigment and another type (B) of the magnetite has an oil absorption number in the range of 20 to 40 g/100 g pigment. The binder contains hydrophilic functional groups and has an acid number in the range of 5 to 50 KOH/g.

13 Claims, No Drawings

MAGNETIC CARRIER PARTICLES

DESCRIPTION

The present invention relates to magnetic carrier particles for use in conjunction with toner particles in the development of electrostatic change patterns.

A variety of electrostatic developers is available for use in developing electrostatic charge patterns. According to a known embodiment the developer comprises carrier particles and electroscopic marking or toner particles electrostatically adhering thereto. The carrier particles may comprise various materials and as the name implies, serve as a medium for carrying the electrostatically responsive marking particles to the change pattern to be developed. Among the more common types of carrier-toner developers are dry developers known for use in magnetic brush development as described e.g. in U.S. Pat. No. 3,003,462.

The common magnetic brush development technique involves the use of magnetic means associated with a developing mixture composed of magnetic carrier particles carrying a number of smaller electrostatically adhering toner particles. In this technique the developer composition is maintained during the development cycle in a loose, brushlike orientation by a magnetic field surrounding, for example, a rotatable non-magnetic cylinder having a magnetic means fixedly mounted inside. The magnetic carrier particles are attracted to the cylinder by the described magnetic field, and the toner particles are held to the carrier particles by virtue of their opposite electrostatic polarity. Before and during development, the toner acquires an electrostatic charge of a sign opposite to that of the carrier material due to triboelectric charging derived from their mutual frictional interaction. When this brushlike mass of magnetic carrier with adhering toner particles is drawn across the photoconductive surface bearing the electrostatic image, the toner particles are electrostatically attracted to an oppositely charged latent image and form a visible toner image corresponding to the electrostatic image.

In magnetic brush development carrier beads have a particle size in the range of 50–300 microns, whereas the toner particles usually have a diameter of about 10 microns.

A common type of carrier particles is made of iron beads either or not covered with a suitable resin coating for providing a desired triboelectric contact with the toner particles. Such kind of carrier particles is suited for development at moderate developing speeds but by their density (about 7.7 g/cm$^3$) represent a fairly high mechanical inertia and correspondingly too slow mixing capacity for use in fast operating devices or will cause undesirable heating due to the high friction forces produced on mixing.

In U.S. Pat. No. 4,600,675 a magnetic carrier is disclosed which is composed preponderantly of fine magnetic powder dispersed in binder resin particles. Said carrier possesses specific properties, i.e. 2000 to 3000 gausses of magnetization in a magnetic field of 1000 oersted (Oe), 60 to 250 oersteds of coercive force, and not less than $10^{12}$ ohm.cm of electric resistance. The magnetic powder is claimed to be a ferrite and the resin binder has hydrophilic functional groups in an amount such that the acid value of the resin binder is in the range of 5 to 250 mg KOH/g, the weight ratio of magnetic powder to resin binder being in the range of 350–800 to 100.

Ferrites are in comparison with common iron oxides rather expensive substances and if possible should be replaced by cheaper materials. In said U.S. patent reference the use of magnetite as magnetic pigment has been rejected because of its lower electrical resistance and inferior compatibility with resin possessing hydrophilic functional groups.

The use of needle-like $Fe_2O_3$ pigments results in the production of carrier particles with higher remanence and hence bad flowing properties in the developing unit and poor toner-take up. A too low magnetization on the other hand results in weak adherence to the magnetic brush developing means and deposition of carrier on the change carrying photoconductor recording element.

It is an object of the present invention to provide carrier particles comprising a magnetite composition that yields in admixture with acidic binder resins an improved homogeneous distribution of magnetite in the binder whereby said carrier particles obtain improved properties for use in magnetic brush development.

Object objects and advantages will become apparent from the hereinafter following description and examples.

In accordance with the present invention a particulate material suited for serving as a carrier particles in magnetic brush toner-carrier development of electrostatic charge patterns is provided, said particles comprising finely divided magnetite powder dispersed in a resin binder, characterized in that:

(1) said magnetide powder is a mixture of magnetites comprising one type (A) of magnetite having an oil absorption number in the range of 10 to 20 g/100 g pigment and another type (B) of magnetite having an oil absorption number in the range of 20 to 40 g/100 g pigment, the weight ratio of (A) to (B) being in the range of 0.3 to 3.0, and said magnetites both having a non-needle-like shape, preferably a spherical or spheroidal shape, and an average particle size in the range of 0.05 to 3 μm, (2) said binder consists for at least 80% by weight of a resin that has a softening point above 80° C., contains hydrophilic functional groups and has an acid number of OH-value in the range of 5 to 50 mg KOH/g, and (3) said carrier particles have a size in the range of 20 to 150 μm, have a magnetite content of at least 70% by weight of the total carrier content, obtain an induced magnetic moment of at least 20 emu/g in an applied field of 1,000 gauss, have a remanence in emu/g of at least 3, and have a ceorcivity in Oe at least 60.

Preferred magnetites have a saturation magnetization in emu/g of 65–120, have a coercivity in Oe of 60–250, have a remanence in emu/g of 5 to 15 and a specific resistivity of at least $10^5$ ohm.cm.

The oil absorption number is measured according to the method described in DIN 53199, proceeding as follows:

the pigment involved in the test is applied to a roughened glass plate. The weight of the sample weighed (2–10 g) depends on the oil absorption expected. To start, ⅔ of the required quantity of untreated linseed oil (to DIN 55930, acid value at least 3) is added from a burette, then being intensively mixed with a spatula and processed under pressure until the mass is homogeneous. Oil is then added drop-by-drop, until a cohesive, putty-like mass is obtained which can just not quite be spread on the glass plate. The quantity of oil required for this purpose is accurately read off in ml.

$$\text{oil absorption} = \frac{\text{oil quantity (ml)} \times 0.93 \times 100}{\text{pigment weight (g)}}$$

The oil absorption value provides information as to the binder and solvent requirement of a pigment or a coating mix made therof.

The preparation of sphere-like magnetite particles having a low oil absorption (i.e. lower than 20 g/100 g pigment) is described in published European Patent Application No. 0 187434.

The magnetic data of the magnetite were measured on a vibration magnetometer operating with a field strenght of 3.5 kOe: the density of the magnetite used for the calculation was 4.6 g/cm$^3$.

The induced magnetic moment of at least 20 emu/g in an applied field of 1,000 gauss equivalent to 0.1 tesla (T), means that, as described in U.S. Pat. No. 4,546,060, the carrier particles are withheld on the magnetic brush developer roller sleeve and do not transfer to the image with the toner. Magnetic brush development is illustrated in FIG. 2 of Physics Today/May 1986, p. 48) and in FIG. 1 of U.S. Pat. No. 4,600,675.

The binder resin containing hydrophilic functional groups is e.g. of the type described in U.S. Pat. No. 4,600,675, wherein the hydrophilic groups are preferably at least partly carboxylic acid groups present in an amount sufficient to provide resins with an acid value, also called acid number, in the range of 5 to 250 mg/g.

Preferred resins are copolymers of styrene with unsaturated acids such as acrylic acid and methacrylic acid and alkyl esters thereof. Further polyester resins such as those produced by condensation reaction of a polyol or mixture of polyols, e.g. ethylene glycol, triethylene glycol and an alkoxylated bisphenol, especially bisphenol A, i.e. [2,2-bis(4-hydroxyphenyl)-propane], with a dicarboxylic acid or mixture of dicarboxylic acids, e.g. maleic acid, fumaric acid, itaconic acid, malonic acid, isophthalic acid and partly of a polyacid having at least 3 carboxylic acid groups such as trimellitic acid yielding some crosslinking are suitable binder resins for the purpose of the present invention.

The preparation of linear polyester resins of the above type is described in GB Pat. No. 1,373,220.

A particularly useful polyester binder is derived from fumaric acid that is polycondensed with an ethoxylated "bisphenol A", i.e. ethoxylated 2,2-bis(4-hydroxyphenyl)propane.

In order to obtain carrier compositions having high resistance to abrasion polyester resins containing some degree of crosslinking are preferred.

The synthesis of such resins is described e.g. in published GB-2082788A patent application disclosing toner comprising as a binder a polyester resin obtained from a diol or mixture of diols represented by the following general formula:

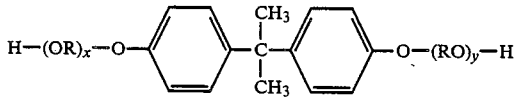

wherein R represents an ethylene or propylene group, x and y are independent numbers such that the average value of their sum is 2 to 7; and a polycarboxylic acid or a derivative thereof, which is a mixture of a dicarboxylic acid or a $C_{1-6}$ alkyl ester thereof and a tri- or polycarboxylic acid or an acid anhydride thereof, the content of said tri- or polycarboxylic acid or acid anhydride being from 30 to 80 mol% of the acids.

It has been established experimentally also that the resistance to abrasion can likewise be improved by combining the above polyester resins with copolymers of styrene and allyl alcohol. The presence of the free hydroxyl group of the allyl alcohol units provides a good wetting powder for hydratable metal oxides.

The preparation of allyl alcohol-styrene copolymers is described by Schildknecht in "Allyl Compounds and their Polymers" Vol. 28, p. 204–206 (1973), John Wiley & Sons, Interscience Publishers, U.S.A.

Particularly suitable styrene allyl alcohol copolymers have a hydroxyl content of 5.4 to 6% by weight and a molecular weight in the range of 1,500 to 2,400 and are sold under the trade names RJ 100 and RJ 101 of Monsanto U.S.A. The styrene ally alcohol copolymers are preferably used in amount of 10 to 20% by weight with respect to the total binder content of the carrier particles.

The magnetic carrier particles according to the present invention can be produced by dispersing the magnetite powder in the resin binder melt, allowing to solidify the molten dispersion and crushing and milling the obtained solid. By wind sifting or sieving particles sizing in the range of 35 to 150 μm are separated.

According to a particular embodiment the magnetite is incorporated in the binder in combination with carbon black controlling in that way the specific resistivity of the carrier particles. A suitable amount of carbon black is in the range of 0.2 to 5% by weight with respect to the magnetite.

In order to obtain a carrier particles with good flowing properties flow enhancing agents can be melt-mixed within the carrier composition yielding a carrier particle surface provided with small spacer particles, that are optionally embedded therein after the milling process. Suitable flow improving agents are e.g. colloidal silica and $Al_2O_3$-particles of sub-micron particle size. Another way to improve the flowing properties is by producing carrier particles having a spherical or spheroidal shape.

Such can proceed by spraying a melt or according to a heating-dispersion technique described in U.S. Pat. No. 4,345,015. According to the latter technique carrier particles obtained by crushing are dispersed in a carrier liquid in which the resin binder does not dissolve in the presence of colloidal hydrophobic silica in a concentration to inhibit coagulation of the particulate material when heat-softening the resin binder; the dispersion is heated with stirring to a temperature at which the resin of the particles softens but does not melt and the particles acquire a spherical or spheroidal shape and the dispersion is then cooled down to a temperature at which the resin binder of the particles is no longer sticky, and finally the carrier particles are separated, e.g. by filtering or centrifuging and dried. The amount of hydrophobic colloidal silica generally ranges from 0.2 to 2.0 parts by weight per 100 parts by weight of carrier particles and has no detrimental influence on triboelectric properties, and further promotes flowing properties as explained above by being partially embedded in the carrier surface.

The toner for use in combination with carrier particles of the present invention can be selected of a wide variety of materials, including both natural and synthetic resins and charge controlling agents as disclosed e.g. in U.S. Pat. Nos. 4,076,857 and 4,546,060. The carrier particles of the present invention may be used in combination with a starter and replenisher toner of different average grain size as described e.g. in published EP-A 0248119.

The shape of the toner particles can be irregular, as is the case in ground toners, or spheroidal. Spheroidization may proceed by spray-drying or the heat-dispersion process disclosed in U.S. Pat. No. 4,345,015.

In the following illustrative examples all ratios and percentages are by weight unless otherwise indicated.

EXAMPLE 1

A mixture containing:

(1) 185 parts of a partially crosslinked polyester of propoxylated bisphenol A polycondensed with a mixture of isophthalic acid and benzene-1,2,4-tricarboxylic acid characterized by a softening point of 132° C. (ring and ball method), glass transition temperature of 64° C., and acid value 18 mg KOH/g, (2) 375 parts of spheroidal magnetite A having an oil absorption number of 16, having an average particle size of 0.5 μm, magnetization saturation in emu/g of 81 and remanence in emu/g of 8.1, said magnetite being sold under the trade name BAYFERROX of Bayer AG, W. Germany, and (3) 440 parts of spheroidal-magnetite B having an oil absorption number of 31, having an average particle size of 0.2 μm, maximum saturation magnetization of 84 emu/g and remanence in emu/g of 8.2 said magnetite being sold under the trade name MAPICO Black 200 by Titan Kogyo, Japan, was melt-kneaded for 30 min at 162° C.

Excellent mixing-homogenization was obtained as was seen under the microscope.

After cooling the kneaded mass was pulverised in an impact mill and powder particles sized between 36 and 100 μm were separated by sieves of suited mesh.

The magnetic properties, viz. magnetization (B 1000) at 1,000 gauss, remanence (Br) in emu/g and coercitive force (Hc) in Oe of the carrier were measured and the results are shown in Table 1 following the examples.

The obtained carrier particles were used in magnetic brush development in combination with toner particles prepared as described hereinafter in a carrier/toner weight ratio of 100:12.

The tribo-electric charge of the developer was determined by blow-off methods and yielded 3.45 μC/g.

The developer was used in a copier system, using a negative chargeable organic photoconductor. High quality prints were realised with good solid black and sharpness characteristics for more than 120,000 copies.

Toner preparation 88.25 parts of the polymer prepared as described hereinafter, 6 parts of carbon black (average particle size 25 nm), 0.75 parts of BONTRON S36 (trade name) as negative charge controlling agent and 5 parts of isotactic and polypropylene (melting point: Tm=145° C.) are mixed in a kneader and heated at 153° C. to form a melt. BONTRON S36 is a trade name of Oriental Chemical Industries-Japan for a metal complex azo dye.

After about 30 minutes the kneading was stopped and the mixture was allowed to cool to room temperature (20° C.). At that temperature the mixture was crushed and milled to form a powder. The obtained powder was further reduced in grain size by jet mill to obtain an average particle size of 9 μm.

To improve the flow properties of the toner 0.2 parts of colloidal silica (average particle size 20 nm) were admixed thereto.

Preparation of the copolymer:

Copoly(styrene/n-octadecylmethacrylate/ethylene glycol dimethacrylate)(82.6/16/1.4 wt.%)

In a double-wall 10 l glass-reactor provided with stirrer, thermometer, reflux condenser, nitrogen inlet, cooling spiral and thermostatic device for controlling the reaction temperature were introduced:

5000 ml of demineralized water and 50 g of copoly(-vinyl alcohol/vinyl acetate)(80/20 wt.) as dispersing aid. The solution was heated to 90° C. while stirring and introducing nitrogen gass. At that temperature over a period of 20 min the following ingredients were introduced:

| | |
|---|---|
| benzoylperoxide | 37.5 g |
| styrene | 826 g |
| n-octadecyl methacrylate | 160 g |
| ethylene glycol dimethacrylate | 14 g |

Polymerization was carried on for 20 h at 90° C. while stirring.

After cooling the formed pearls were separated by suction filtering, once washed with water and twice with methanol. The copolymer pearls were dried at 40° C. up to constant weight value. Polymer yield about 85% of the theoretical value.

EXAMPLE '

Example 1 was repeated using a linear polyester as binder resin, being a propoxylated bisphenol A-fumaric acid polycondensation product, having a softening point of 94° C. (ring and ball method), glass transition temperature of 58° C. and acid number 139 being sold under the trade name ATLAC 382 E of Atlas Chemical Industries Inc.-Wilmington, Del. U.S.A.

The mixing in melt kneader proceeded at 134° C. and resulted in a good homogenization. The magnetic data of the obtained carrier particles are given in Table 1.

The obtained carrier particles were used in magnitude brush development as described in Example 1. The tribo-electric charge of the developer was 5.6 μC./g. The developer yielded high quality prints over a copy volume up to 50,000 copies.

EXAMPLES 3-5

The preparation of the carrier particles of Example 1 was repeated with the difference however, that different ratios by weight (parts wt) of the therein mentioned magnetites were used and the total magnetite concentration was increased. The applied magnetite ratios, the magnetite A and B contents and the kneading temperatures are mentioned in Table 2.

In some carrier composition there was melt-mixed not only magnetic pigment but also colloidal silica (AEROSOL 200 trade name of Degussa-W. Germany) or with carbon black (KETJEN-BLACK EC of Ketjen N. V.-The Netherlands).

Corresponding developers showed good charge, abrasion resistance and copy quality. Where silica was added to the carrier composition in the milling stage a developer with improved flow was obtained.

The addition of carbon black increased the developer conductivity by a factor 2.

EXAMPLE 6

The carrier particles obtained as described in Example 1 were subjected to a spheroidization process by dispersing the particles in an ethanol/water mixture (⅓ by volume), the concentration of carrier being 200 g/l. Spheroidization was obtained by heating the dispersion to 73° C. for 30 min, under vigorous stirring. After cooling, the dispersion was filtered, the carrier beads washed, magnetically separated and dried. Inspection under a microscope revealed no agglomeration and successful spheroidization.

A substantial improvement in developer flowability was obtained.

EXAMPLE 7 (comparative example)

Example 1 was repeated with only magnetite A in the same amount as the total magnetite amount used in said Example.

Proceeding that way no homogeneous distribution of the magnetite could be obtained in the applied binder resin; even by effecting the kneading mixing in the temperature range of 185°-240° C. At 185° C. binder decomposition started and no proper mixing could be obtained.

EXAMPLE 8 (comparative example)

Example 1 was repeated with only magnetite B in the same amount as the total magnetite amount used in said Example.

Proceeding that way no homogeneous distribution of the magnetite could be obtained in the applied binder resin; even by effecting the kneading mixing in the temperature range of 185°-240° C. At 185° C. binder decomposition started and no proper mixing could be obtained.

TABLE 1

| Example | B 1000 (emu/g) | Br (emu/g) | Hc (Oe) |
|---|---|---|---|
| 1 | 53 | 6.7 | 97 |
| 2 | 52 | 7.2 | 92 |
| 3 | 53 | 8.4 | 111 |
| 4 | 53 | 8.0 | 95 |
| 5 | 53 | 7.4 | 108 |
| 6 | 53 | 6.9 | 96 |

TABLE 2

| Example | Magnetite A parts wt | Magnetite B parts wt | SiO2 parts wt | CB parts wt | Temperature kneader °C |
|---|---|---|---|---|---|
| 3 | 535 | 290 | — | — | 165 |
| 4 | 535 | 290 | 0.25 | — | 163 |
| 5 | 535 | 290 | 0.25 | 0.25 | 164 |
| 6 | 375 | 440 | — | — | — |

What is claimed is:

1. A particulate triboelectrically developer composition for the magnetic brush toner-carrier development of electrostatic charge patterns, which comprises finely divided toner particles and carrier particles, said carrier particles having a particle size of about 35-150 μm and comprising finely divided magnetite powder dispersed in a resin binder and said toner particles having a smaller particle size, wherein:

(1) said magnetite powder is a mixture of magnetites comprising one type (A) of magnetite having an oil absorption number in the range of 10 to 20 g/100 g pigment and another type (B) of magnetite having an oil absorption number in the range of 20 to 40 g/100 g pigment, the difference in said oil absorption numbers being sufficient to permit homogeneous distribution of said magnetite powder in said resin binder, the weight ratio of (A) to (B) being in the range of 0.3 to 3.0, and said magnetites both having a non-needle like shape and an average particle size in the range of 0.05 to 3 μm, (2) said binder consists for at least 80% by weight of a resin that has a softening point above 80° C., contains hydrophilic functional groups and has an acid number in the range of 5 to 50 mg KOH/g, said resin being a partially cross-linked polyester resin produced by condensation reaction of at least one polyol of the group consisting of ethylene glycol, triethylene glycol and an alkoxylated bisphenol with at least one dicarboxylic acid of the group consisting of maleic acid, fumeric acid, itaconic acid, malonic acid, and isophthalic acid, and a sufficient amount of a polyacid having at least 3 carboxylic acid groups to partially cross link said resin and to impart said acid number thereto, and (3) said carrier particles have a size in the range of 20 to 150 μm, have a magnetite content of at least 70% by weight of the total carrier content, obtain an induced magnetic moment of at least 20 emu/g in an applied field of 1,000 gauss, have a remanence in emu/g of at least 3, and have a coercitivity in Oe at least 60.

2. A particulate material according to claim 1, wherein said magnetites have a spherical or spheroidal shape.

3. A particulate material according to claim 1, wherein said magnetites have a saturation magnetization in emu/g of 65-110, have a coercitivity in Oe of 60-250, have a remanence in emu/g of 5 to 15 and a specific resistivity at least $10^5$ ohm.cm.

4. A particulate material according to claim 1, wherein said material has an induced magnetic moment in the range of 40-70 emu/g.

5. A particulate material according to claim 1, wherein said resin binder has a softening point in the range of 110° to 140° C.

6. A particulate material according to claim 1, wherein said binder is a polyester resin deviated from a diol or mixture of diols represented by the following general formula:

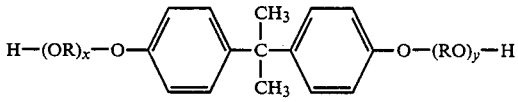

wherein R represents an ethylene or propylene group, x and y are independent numbers such that the average value of their sum is 2 to 7; and a polycarboxylic acid or a derivative thereof, which is a mixture of a dicarboxylic acid or a $C_{1-6}$ alkyl ester thereof and a tri- or polycarboxylic acid or an acid anhydride thereof, the content of said tri- or polycarboxylic acid or acid anhydride being from 30 to 80 mol% of the acids.

7. A particulate material according to claim 1, wherein said binder further comprises a polyester binder derived from fumaric acid that is polycondensed with ethoxylated 2,2-bis(4-hydroxyphenol) propane.

8. A particulate material according to claim 1, wherein the polyester resin is combined with a copolymer of styrene and allyl alcohol.

9. A particulate material according to claim 1, wherein in order to improve flowing properties colloidal silica is mixed with the carrier particles and/or embedded in the carrier surface.

10. A particulate material according to claim 1, wherein in order to control the specific resistivity of the particles the magnetite is present in the binder in combination with carbon black.

11. A particulate material according to claim 1, wherein the carrier particles have a spherical or spheroidal shape.

12. A particulate material according to claim 1, wherein said magnetites have a spherical or spheroidal shape.

13. A particulate material according to claim 1, wherein said resin binder has a softening point in the range of 110° to 140° C.

* * * * *

UNITED STATES PATENT AND TRADEMARK OFFICE

CERTIFICATE OF CORRECTION

PATENT NO. : 4,879,198

DATED : November 7, 1989

INVENTOR(S) : Tavernier et al

It is certified that error appears in the above-identified patent and that said Letters Patent is hereby corrected as shown below:

In Claim 1, line 1, after "triboelectrically", insert -- chargeable --.

Signed and Sealed this

Thirtieth Day of October, 1990

*Attest:*

HARRY F. MANBECK, JR.

*Attesting Officer*

*Commissioner of Patents and Trademarks*